US008485631B2

(12) United States Patent
Mitsuhashi et al.

(10) Patent No.: US 8,485,631 B2
(45) Date of Patent: Jul. 16, 2013

(54) RECORDING DEVICE, METHOD OF GENERATING CORRECTION CHART, AND METHOD OF TRANSPORTING MEDIUM

(75) Inventors: Masato Mitsuhashi, Hara-mura (JP); Takeshi Shiode, Matsumoto (JP); Tomohiro Yuda, Minowa-machi (JP); Tatsuya Nakano, Shiojiri (JP); Toshiaki Ishikawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 54 days.

(21) Appl. No.: 13/214,166

(22) Filed: Aug. 20, 2011

(65) Prior Publication Data

US 2012/0042760 A1 Feb. 23, 2012

(30) Foreign Application Priority Data

Aug. 23, 2010 (JP) ..... 2010-186568

(51) Int. Cl.
*B41J 29/38* (2006.01)
*B41J 2/01* (2006.01)

(52) U.S. Cl.
USPC ..... 347/16; 347/101

(58) Field of Classification Search
None
See application file for complete search history.

(56) References Cited

U.S. PATENT DOCUMENTS 5,628,574 A * 5/1997 Crowley ..... 400/621
6,520,080 B1 * 2/2003 Fried ..... 101/227
7,417,655 B2 * 8/2008 Tsubota ..... 347/171

FOREIGN PATENT DOCUMENTS

JP 08-101618 A 4/1996

* cited by examiner

*Primary Examiner* — Geoffrey Mruk
(74) *Attorney, Agent, or Firm* — Maschoff Brennan

(57) ABSTRACT

When an original point position of a transport roller is detected using an original point detecting sensor and a downstream end in the transport direction of an elongated sheet is positioned on a more downstream side in the transport direction than a cutting position, the sheet is cut by a cutter. Thereafter, a correction chart is generated by driving the transport roller and a recording unit.

5 Claims, 10 Drawing Sheets

RECORDING DEVICE, METHOD OF GENERATING CORRECTION CHART, AND METHOD OF TRANSPORTING MEDIUM

This application claims the benefit of Japanese Application No. 2010-186568, filed Aug. 23, 2010, all of which are hereby incorporated by reference.

BACKGROUND

1. Technical Field

The present invention relates to a recording device attaching a fluid to a medium transported along a transport direction to perform a recording process, a method of generating a correction chart in which marks are formed at a plurality of positions to generate the correction chart in the transport direction of the medium, and a method of transporting a medium in which the medium subjected to the recording process is transported along the transport direction.

2. Related Art

Generally, as a recording device performing a recording process on a medium transported in a transport direction, a recording device alternately repeating a transport process of a sheet as an example of the medium and an attachment process of attaching a fluid to the sheet to perform recording on the sheet is known. A transport device (transport unit) provided in such a recording device is provided with a transport roller disposed further to the upstream side in the transport direction than a recording unit attaching the fluid to the sheet, and a transport motor for applying driving power to the transport roller. At the time of the transport process, the transport motor is controlled to change a rotation position of the transport roller for each set unit angle.

In regard to controlling a transport amount of a sheet, it is preferable that the rotation axis of the transport roller coincide with the center axis of the transport roller. However, in regard to precision in production, it is very difficult for the rotation axis to completely coincide with the center axis. That is, the transport roller is slightly eccentric. For this reason, the transport amount of a sheet (hereinafter, also referred to as "first transport amount") when the transport roller in which the rotation position is a first position is rotated by a unit angle, and a transport amount of a sheet (hereinafter, also referred to as "second transport amount") when the transport roller in which the rotation position is a second position is rotated by a unit angle may be different from each other. Such a problem may occur not only when the transport roller is eccentric, but also when an outer circumferential face of the transport roller is deformed by abrasion or the like.

For this reason, in order to reduce the error between the first transport amount and the second transport amount, it is necessary to adjust the rotation amount of the transport roller for each rotation position of the transport roller. From this viewpoint, as a method of correcting the rotation amount of the transport roller at the time of the transport process, that is, the driving amount of the transport motor, a correction method described in JP-A-8-101618 has been proposed.

In the correction method described in JP-A-8-101618, marks are recorded on the sheet transported in the transport direction at a constant interval. Then, a correction chart in which a plurality of marks is formed in the first direction corresponding to the transport direction is generated. In such a correction chart, the interval between marks adjacent to each other along the first direction is an interval corresponding to the degree of the eccentricity of the transport roller. The first transport amount of a sheet when the rotation position of the transport roller is the first position, and the second transport amount of a sheet when the rotation position of the transport roller is the second position are calculated, and correction data based on the calculated rotation positions of the transport roller and the transport amount for each of the rotation positions is generated. At the time of the transport process, the rotation amount of the transport roller is adjusted on the basis of the correction data generated above, to suppress a difference in the transport amount of a sheet for each rotation position of the transport roller.

However, in recent years, development of a recording device provided with a cutting unit to cut a sheet at a cutting position further to the downstream side than a recording unit in the transport direction has proceeded. When a correction chart is generated according to the method described above with such a recording device, the original point position in the circumferential direction of the transport roller is detected, and the driving of the transport roller and the recording unit is controlled to generate the correction chart from the timing when the original point position is detected.

However, when the correction chart is generated by a recording device having the cutting function, a problem represented hereinafter may occur. That is, a discharge unit such as a discharge roller to discharge a part detached from the sheet, to the downstream side in the transport direction is provided on the downstream side of the cutting position in the transport direction of the sheet. At the time of generating the correction chart, the downstream end (hereinafter, also referred to as the "leading end of the sheet") in the transport direction of the sheet may come in contact with the discharge unit. In this case, a load based on the contact between the leading end of the sheet and the discharge unit is applied to the transport roller (i.e., the transport motor) through the sheet. At this time, the magnitude of the load applied to the transport motor is changed according to the degree of contact between the sheet and the discharge unit. When the magnitude of the load applied to the transport motor is changed during transport of the sheet as described above, the transport amount of the sheet may be changed also according to the change of the load. For this reason, when the correction chart is generated, it is necessary to make position in the transport direction of the leading end of the sheet constant at the generation start point.

As an example of a method of accurately adjusting the position of the leading end of the sheet, a method is conceivable in which the absolute position type encoder to detect the absolute position in the rotation direction of the transport roller is provided, and the rotation position of the transport roller is adjusted such that the leading end of the sheet at the time of generating the correction chart is located at a predetermined position. In this case, since it is possible to prevent the load applied to the transport motor from being changed whenever the correction chart is generated, it is possible to stabilize and generate the correction chart. However, the absolute position type encoder is very expensive, and there is a problem that the recording device becomes expensive.

To "stabilize and generate the correction chart" means that it is possible to generate a correction chart equivalent to the previous correction chart if the shape of the outer circumferential face of the transport roller is not changed from the time the previous correction chart was generated.

SUMMARY

An advantage of some aspects of the invention is to provide a recording device capable of stabilizing and generating a correction chart while suppressing a high cost, a method of generating the correction chart, and a method of transporting a medium.

According to an aspect of the invention, there is provided a recording device including: a transport unit that has a transport roller rotating to transport a medium along a transport direction; a recording unit that attaches a fluid to the medium transported by the transport unit; a generation unit that controls the transport unit and the recording unit to generate a correction chart in which marks are formed at a plurality of positions in the transport direction by the attachment of the fluid to the medium; a cutting unit that cuts the medium at a cutting position set on the downstream side in the transport direction of the transport roller; and a detection unit that has a detection target unit provided to be rotatable integrally with the transport roller and a detector detecting the detection target unit moving to an original point position in the circumferential direction, wherein when the original point position of the transport roller is detected by the detection unit and the downstream end in the transport direction of the medium is positioned further to the downstream side in the transport direction than the cutting position, the generation unit controls the cutting unit to cut the medium and then controls the transport unit and the recording unit to generate the correction chart.

With such a configuration, when the detection target unit is moved to the original point position in the circumferential direction at the time of rotating the transport roller, through the detector detecting the detection target unit, the original point position of the transport roller is detected. In a step in which the original point position of the transport roller is detected by the detection unit as described above, when the downstream end (hereinafter, also referred to as the "leading end of the medium") of the medium in the transport direction is positioned further to the downstream side in the transport direction than the cutting position, the medium is cut by the cutting unit. That is, a part positioned further to the downstream side in the transport direction than the cutting position with respect to the medium is detached from the medium. Thereafter, the correction chart is generated on the medium by driving the transport unit and the recording unit. For this reason, when the generation of the correction chart is started, the leading end of the sheet is necessarily positioned at the cutting position. That is, a load applied to the transport roller and the transport motor through the medium at the time point of starting the generation of the correction chart is substantially constant every time. In addition, since it is possible to detect the original point position even when an absolute position type encoder is not used, it is possible to achieve cost decreases as compared with a case of providing the recording device with the absolute position type encoder. Accordingly, it is possible to stabilize and generate the correction chart while suppressing cost increases.

The recording device according to the aspect of the invention may further include a discharge unit that is provided further to the downstream side than the cutting position in the transport direction and transports the medium to the downstream side in the transport direction.

With such a configuration, the timing when the leading end of the medium comes in contact with the discharge unit is not changed whenever the correction chart is generated. For this reason, the load applied to the transport roller and the transport motor through the medium is not changed whenever the correction chart is generated. Accordingly, it is possible to stabilize and generate the correction chart.

The recording device according to the aspect of the invention may further include a collection unit that is provided on a lower side in the gravity direction of the cutting position and collects a cut part detached from the medium by the cutting unit; and a cutting control unit that controls the cutting unit when the correction chart is generated by the generation unit, wherein when the original point position of the transport roller is not detected by the detection unit and a protrusion amount of the medium further to the downstream side in the transport direction than the cutting position is equal to or more than a referential protrusion amount set to an amount less than the transport amount of the medium corresponding to one rotation of the transport roller, the cutting control unit controls the cutting unit to detach a part positioned further to the downstream side in the transport direction than the cutting position.

When the cutting of the medium by the cutting unit is not performed until the original point position of the transport roller is detected, and the original point position of the transport roller is detected, a cut part with a size corresponding to the transport amount of the medium when rotating the transport roller once may be detached from the medium. For this reason, it is necessary to configure the collection unit to collect such a relatively large cut part. From this viewpoint, in the aspect of the invention, the size of the cut part detached from the medium by the cutting unit is smaller than the size corresponding to the transport amount of the medium when rotating the transport roller once. For this reason, it is possible to shorten the length in the transport direction of the collection unit as compared with the case of not performing the cutting of the medium by the cutting unit until the original point position of the transport roller is detected, and further it is possible to contribute to miniaturization of the whole recording device.

In the recording device according to the aspect of the invention, the transport unit may have a transport motor generating driving power to rotate the transport roller, and the recording device may further include: an input unit to which correction data based on the generated correction chart is input; a storage unit that stores a correction map which is a map based on the correction chart and in which a plurality of rotation positions of the transport roller is associated with the correction amounts of the rotation positions, respectively; and a transport control unit that adjusts the driving amount of the transport motor for each rotation position of the transport roller on the basis of the correction map stored in the storage unit at the time of a recording process on the medium using the fluid.

With such a configuration, the correction map in which the plurality of rotation positions of the transport roller is associated with the correction amounts of the rotation positions is stored in the storage unit by inputting the correction data based on the generated correction chart. At the time of the transport control of the medium in the recording process, the driving amount of the transport motor is adjusted for each rotation position of the transport roller on the basis of the correction map stored in the storage unit. Accordingly, it is possible to suppress the difference in the transport amount of the medium, and further it is possible to improve quality of an image recorded on the medium by the recording device.

In the recording device of the aspect of the invention, the transport unit may have a transport motor generating driving power to rotate the transport roller, and the recording device may further include: a reading unit that is provided further to the downstream side in the transport direction than the cutting position and reads an image recorded on a recording face of the medium opposed to the recording unit in the medium; an acquisition unit that acquires the interval of the marks formed on the correction chart for each rotation position of the a transport roller when the correction chart formed on the medium is read by the reading unit; a creation unit that creates a correction map in which a plurality of rotation positions of the transport roller is associated with correction amounts for the rotation positions on the basis of the acquisition result acquired by the acquisition unit; a storage unit in which the correction map created by the creation unit is stored; and a transport control unit that adjusts the driving amount of the transport motor for each rotation position of the transport roller on the basis of the correction map stored in the storage unit at the time of the recording process on the medium using the fluid.

With such a configuration, the interval between the marks of the generated correction chart are automatically read by the reading unit, and the correction map in which the plurality of rotation positions of the transport roller is associated with the correction amounts of the rotation positions is automatically created and stored in the storage unit. At the time of the transport control of the medium in the recording process, the driving amount of the transport motor is adjusted for each rotation position of the transport roller on the basis of the correction map stored in the storage unit. Accordingly, it is possible to suppress the difference in the transport amount of the medium without causing the user trouble, and further it is possible to improve quality of an image recorded on the medium by the recording device.

According to another aspect of the invention, there is provided a method of generating a correction chart including: attaching a fluid to a medium transported along a transport direction by rotation of a transport roller to generate the correction chart in which marks are formed at a plurality of positions in the transport direction, wherein a detection unit to detect the original point position in the circumferential direction of the transport roller is provided with a detection target unit provided to be rotatable integrally with the transport roller and a detector detecting the detection target unit moving to the original point position; and detaching the end further to the downstream side than the cutting position from the medium, when the original point position of the transport roller is detected by the detection unit and the downstream end in the transport direction of the medium transported by the rotation of the transport roller is positioned further to the downstream side in the transport direction than a cutting position set further to the downstream side in the transport direction than the transport roller, wherein the generating is performed after the detaching.

With such a configuration, it is possible to obtain the same operation and effect equivalent to those of the recording device.

According to still another aspect of the invention, there is provided a method of transporting a medium in which a transport amount of the medium at the time of a recording process is corrected on the basis of a correction chart generated by the method of generating the correction chart, the method including transporting the medium while adjusting the rotation amount of the transport roller for each rotation position of the transport roller on the basis of the correction map which is a map based on the correction chart and in which a plurality of rotation positions of the transport roller is associated with the rotation positions.

With such a configuration, the rotation amount of the transport roller is adjusted for each rotation position of the transport roller on the basis of the correction map created on the basis of the correction chart at the time of the transport control of the medium in the recording process. Accordingly, it is possible to suppress the difference in the transport amount of the medium, and further it is possible to improve the recording quality of the recording device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment specifying the invention will be described with reference to FIG. 1 to FIG. 10.

Figure 1:
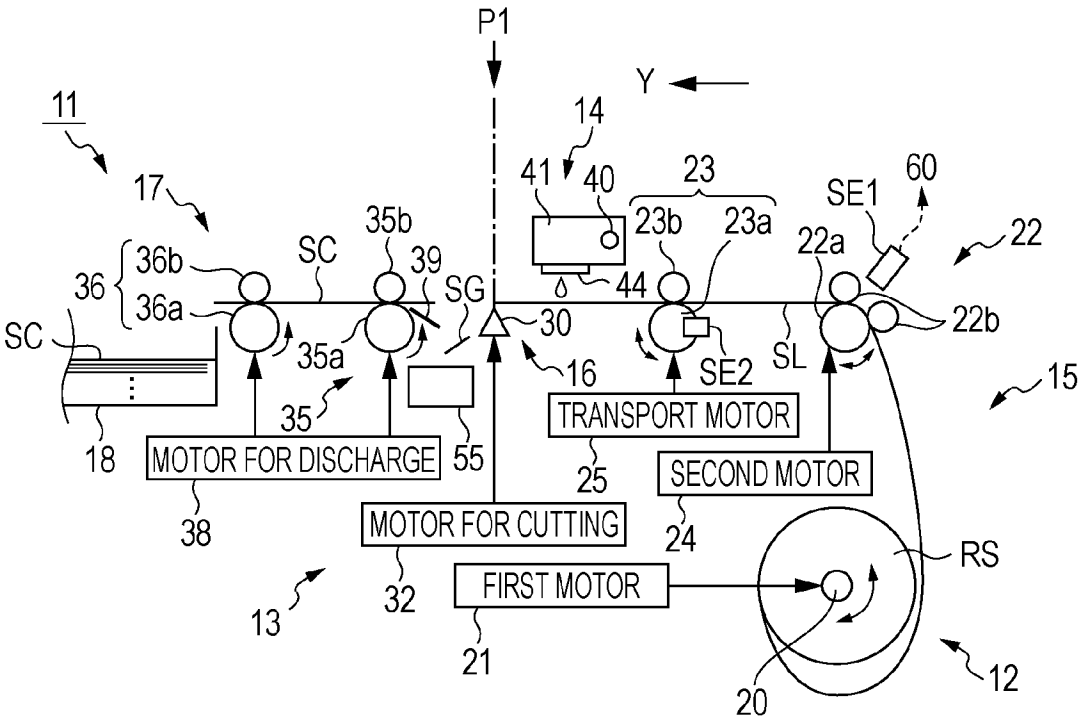
FIG. 1 is a side view schematically illustrating a recording device of a first embodiment.

As shown in FIG. 1, a recording device 11 of the embodiment is a serial-type ink jet printer. The recording device 11 is provided with an accommodation unit 12 that accommodates an elongated sheet SL, as an example of a medium in a roll sheet RS state wound as a roll, and a transport device 13 that sends out and transports the elongated sheet SL from the inside of the accommodation unit 12 little by little. A recording unit 14 as an example of a recording unit for performing recording on the elongated sheet SL is provided at a midway position in the transport direction Y (also referred to as "sub-scanning direction") of the elongated sheet SL.

The transport device 13 is provided with a transport unit 15 as an example of a transport unit for transporting the elongated sheet SL from the upstream side (accommodation unit 12 side) to the downstream side (recording unit 14 side) in the transport direction Y. The transport device 13 is provided with a cutting unit 16 as an example of a cutting unit for cutting the elongated sheet SL at a cutting position P1 of the downstream side (left side in FIG. 1) in the transport direction Y of the recording unit 14. The cutting unit 16 detaches a recording-completed part (downstream side part) SC where the recording is completed on the elongated sheet SL from the elongated sheet SL. A discharge unit 17 as an example of a discharge unit for discharging the recording-completed part SC detached from the elongated sheet SL to a discharge tray 18 positioned on the most downstream side in the transport direction Y is provided on the downstream side in the transport direction Y of the cutting position P1.

In the roll sheet RS of the embodiment, the elongated sheet SL is wound on a shaft member 20 extending in a scanning direction (in the embodiment, it is a direction perpendicular to the paper face and is also referred to as "main scanning direction") perpendicular to the transport direction Y. When the roll sheet RS is set in the accommodation unit 12, the shaft member 20 is connected to a first motor 21 in a state where power can be transmitted. When the driving power from the first motor 21 is transmitted to the shaft member 20, as a result, the shaft member 20 rotates in a predetermined direction, and the roll sheet RS as the elongated sheet SL is sent out along a transport path from the accommodation unit 12.

Next, the transport unit 15 will be described.

As shown in FIG. 1, the transport unit 15 is provided with a sending-out unit 22 to send out the elongated sheet SL from the inside of the accommodation unit 12 little by little, and a transport roller base 23 provided on the downstream side in the transport direction Y of the sending-out unit 22. The sending-out unit 22 is provided with a sending-out roller 22*a* provided on the back side of the elongated sheet SL, and a driven roller 22*b* provided on the front side of the elongated sheet SL. That is, the driven roller 22*b* is opposed to the sending-out roller 22*a* with the elongated sheet interposed therebetween. The sending-out roller 22*a* is connected to a second motor 24 in a state where power can be transmitted. When the driving power from the second motor 24 is transmitted to the sending-out roller 22*a*, the sending-out roller 22*a* is rotated and the driven roller 22*b* is driven to rotate according to the rotation of the sending-out roller 22*a*. As a result, the elongated sheet SL is sent out to the downstream side in the transport direction Y by the sending-out unit 22.

The transport roller base 23 is provided with a transport roller 23*a* and a driven roller 23*b* opposed to each other with the elongated sheet SL and pinching the sheet SL. For example, the transport roller 23*a* is provided on the back side of the elongated sheet SL, and the driven roller 23*b* is provided on the front side of the elongated sheet SL. The transport roller 23*a* is connected to a transport motor 25 in a state where power can be transmitted. When the driving power from the transport motor 25 is transmitted to the transport roller 23*a*, the transport roller 23*a* is rotated and the driven roller 23*b* is driven to rotate according to the rotation of the transport roller 23*a*. As a result, the elongated sheet SL is transported to the downstream side in the transport direction Y of the transport roller base 23.

A leading end detecting sensor SE1 to detect the downstream end (hereinafter, also referred to as "leading end") in the transport direction Y of the elongated sheet SL is provided further to the upstream side in the transport direction Y than the transport roller base 23. A detection signal from the leading end detecting sensor SE1 is output to a control device 60 controlling the recording device 11.

Figure 2:
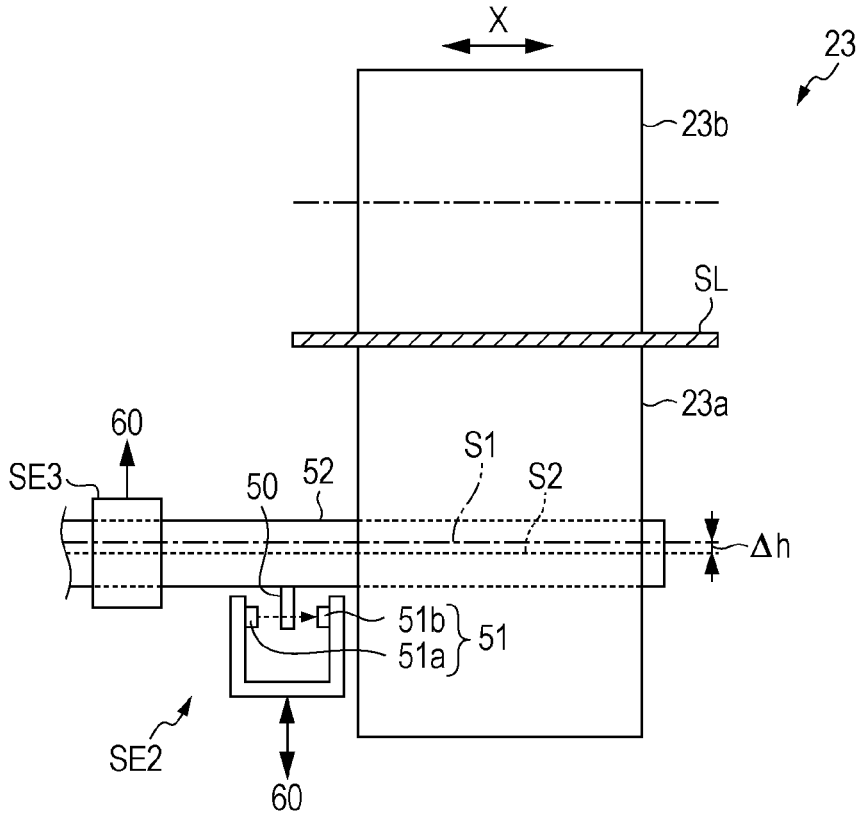
FIG. 2 is a schematic view illustrating a transport roller base.

As shown in FIG. 2 the transport unit 15 is provided with an original point detecting sensor SE2 to detect an original point position of the transport roller 23*a* to which the driving power is transmitted from the transport motor 25, and a rotary encoder SE3. The rotary encoder SE3 is provided to detect the rotation angle from a measurement start position, that is, the rotation amount. The rotary encoder SE3 of the embodiment is a relative position type encoder which cannot detect the absolute position of the rotation direction of the transport roller 23*a* in a single unit of the encoder. That is, the rotary encoder SE3 of the embodiment is very inexpensive as compared with an absolute position type encoder. In FIG. 1, the rotary encoder SE3 is not shown.

The original point detecting sensor SE2 is provided with a detection target unit 50 provided to be rotatable with the transport roller 23*a*, a detector 51 supported through a retention unit (not shown) in a body case (not shown) or the like of the recording device 11. The detection target unit 50 is a protrusion provided on a rotation shaft 52 of the transport roller 23*a* to protrude toward a diameter direction centered on the rotation shaft 52.

The detector 51 is positioned at the original point position (a lower portion of the rotation shaft 52 in FIG. 2) in the circumferential direction centered on the rotation shaft 52. The detector 51 is provided with a light emitting unit 51*a* that is provided on one side (the left side in FIG. 2) in the scanning direction X of the detection target direction 50, and a light receiving unit 51*b* that is provided on the other side (the right side in FIG. 2) in the scanning direction X of the detection target unit 50. Detection light output from the light emitting unit 51*a* is only received by the light receiving unit 51*b* when the detection target unit 50 is not positioned at the original point position in the circumferential direction, and the detection light is blocked by the detection target unit 50 when the detection target unit 50 is positioned at the original point position in the circumferential direction. A detection signal corresponding to the quantity of the light received by the light receiving unit 51*b* is output to the control device 60 from the detector 51. In the embodiment, "a state where the detection target unit 50 is positioned at the original point position in the circumferential direction" is referred to as "a state where the original point position of the transport roller 23*a* is detected".

In the embodiment, the center axis S1 (a line passing through the center of the diameter direction of the transport roller 23*a*, which is represented by a chain line in FIG. 2) of the transport roller 23*a* does not completely coincide with a rotation center S2 (represented by a broken line in FIG. 2) of the transport roller 23*a*. That is, the transport roller 23*a* is eccentric by an error Δh. The eccentricity of the transport roller 23*a* is not intentionally made, and occurs corresponding to precision in production. In FIG. 2, a degree of the eccentricity of the transport roller 23*a* is exaggeratingly drawn.

Next, the cutting unit 16 will be described.

As shown in FIG. 1, the cutting unit 16 is provided with a cutter 30 detaching a part positioned further to the downstream side in the transport direction than a cutting position P1 from the elongated sheet SL. The cutter 30 is connected to a cutting motor 32 in a state where power can be transmitted. When the driving power from the cutting motor 32 is transmitted to the cutter 30, the cutter 30 cuts the elongated sheet SL. A collection box 55 as an example of a collection unit is provided on the lower side in the gravity direction of the cutter 30. The upper side of the gravity direction of the collection box 55 is open. The collection box 55 collects an unnecessary part (the cut part) SG detached from the sheet SL by the cutter 30, when recovering the leading end of the elongated sheet SL.

Next, the discharge unit 17 will be described.

As shown in FIG. 1, the discharge unit 17 is provided with a plurality (two in the embodiment) of discharge roller bases 35 and 36 provided along the transport direction Y. The discharge roller bases 35 and 36 have driving rollers 35*a* and 36*a* pinching the recording-completed part SC and driven rollers 35*b* and 36*b*, respectively. For example, the driving rollers 35*a* and 36*a* are provided on the back side of the recording-completed part SC, and the driven rollers 35*b* and 36*b* are provided on the front side of the recording-completed part SC. The driving rollers 35*a* and 36*a* positioned on the back side of the recording-completed part SC are connected to a discharge motor 38 in a state where power can be transmitted. When the driving power from the discharge motor 38 is transmitted to the driving rollers 35*a* and 36*a*, the recording-completed part SC is discharged to the downstream side in the transport direction Y by the discharge roller bases 35 and 36.

A guide unit 39 to guide the leading end of the elongated sheet SL to the discharge roller base 35 side is provided between the cutting position P1 and the discharge roller base 35 in the transport direction Y.

Next, the recording unit 14 will be described.

Figure 3:
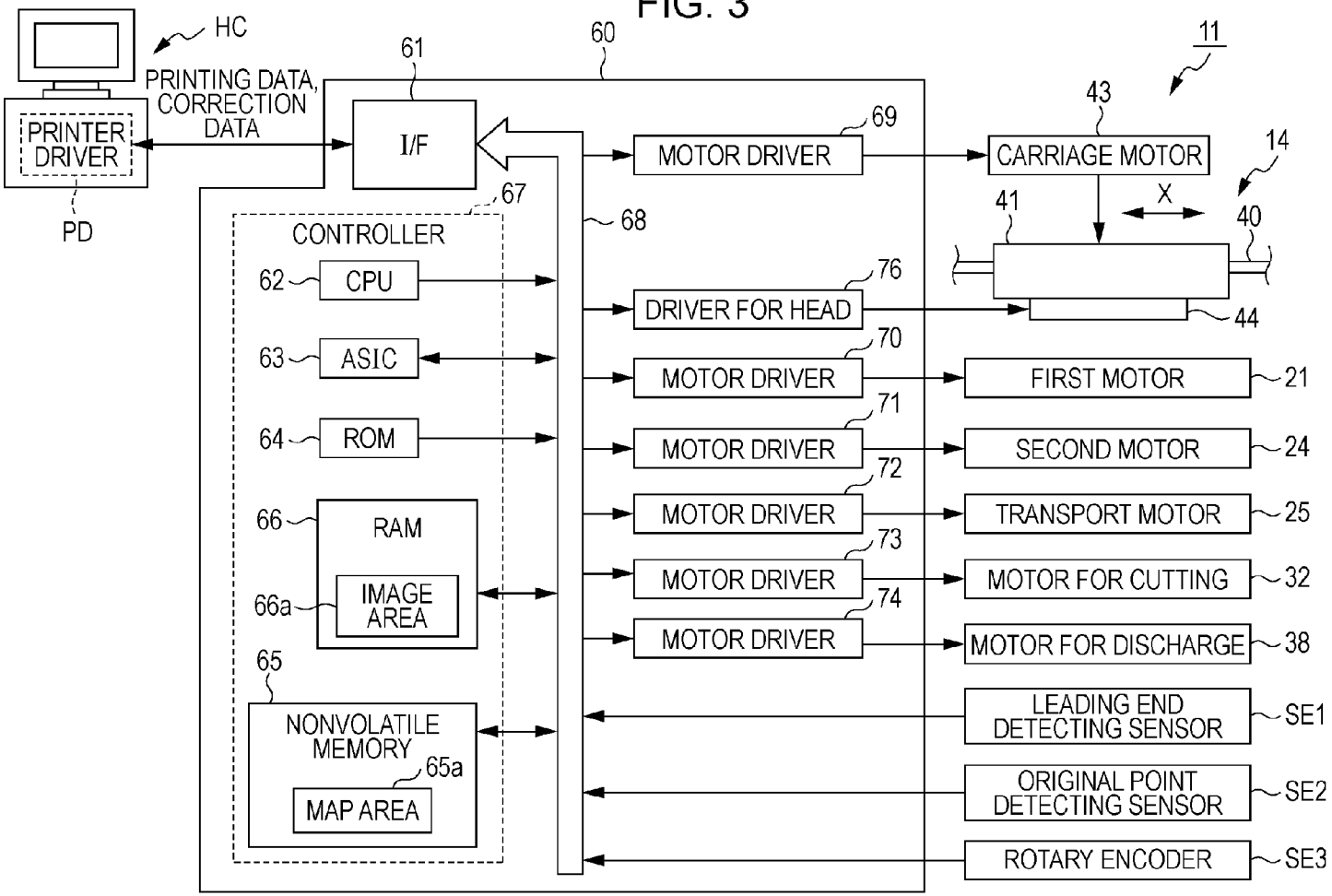
FIG. 3 is a block diagram illustrating main units of an electrical configuration of the recording device.

As shown in FIG. 1 and FIG. 3, the recording unit 14 is provided with a guide shaft 40 extending in the scanning direction X (the direction perpendicular to the paper face in FIG. 1) perpendicular to the transport direction Y. Both ends of the guide shaft 40 in the longitudinal direction are supported by the body case (not shown) of the recording device 11, and are provided on the front side (the upper side in FIG. 1) of the elongated sheet SL. The guide shaft 40 is connected to a carriage 41 in a state where the carriage 41 can reciprocate along the longitudinal direction (i.e., the scanning direction X) of the guide shaft 40. The carriage 41 moves along the scanning direction X on the basis of driving power transmitted from a carriage motor 43.

The carriage 41 supports a recording head 44. An ink as an example of a fluid is supplied from an ink cartridge (not shown) attachably and detachably mounted on a holder portion (not shown) of the recording device 11, to the recording head 44. The recording head 44 is provided with a plurality of nozzles (not shown) and driving elements corresponding to the nozzles. The ink is ejected onto the surface (the surface in FIG. 1) of the elongated sheet SL by driving the corresponding driving elements. A support member (not shown) supporting the sheet SL is provided at the same position as the recording head 44 in the transport direction Y and on the back side of the elongated sheet SL.

Next, an electrical configuration of the recording device 11 will be described.

As shown in FIG. 3, the recording device 11 is provided with the control device 60 controlling the whole of the recording device 11. The control device 60 can transmit and receive various kinds of information such as printing data and correction data to and from a printer driver PD of a host device HC through an interface 61 as an input unit.

The control device 60 is provided with a controller 67 having a CPU 62, an ASIC 63 (Application Specific IC), a ROM 64, a nonvolatile memory 65, and a RAM 66. The controller 67 is electrically connected to various drivers 69, 70, 71, 72, 73, 74, and 76 through a bus 68. The controller 67 controls the motors 21, 24, 25, 32, 38, and 43 through motor driver 69 to 74, and individually controls driving elements in the recording head 44 through a head driver 76.

Various control programs, various data, and the like are stored in the ROM 64. Various programs such as a firmware program, various data necessary for a printing process, and the like are stored in the nonvolatile memory 65. The nonvolatile memory 65 has a map area 65*a* as an example of a storage unit in which a correction map to correct the driving of the transport motor 25 at the time of the recording process is stored. The RAM 66 is provided with an image area 66*a* in which printing data received from the host device HC, processing data of the printing data, and data after processing are stored.

Figure 4:
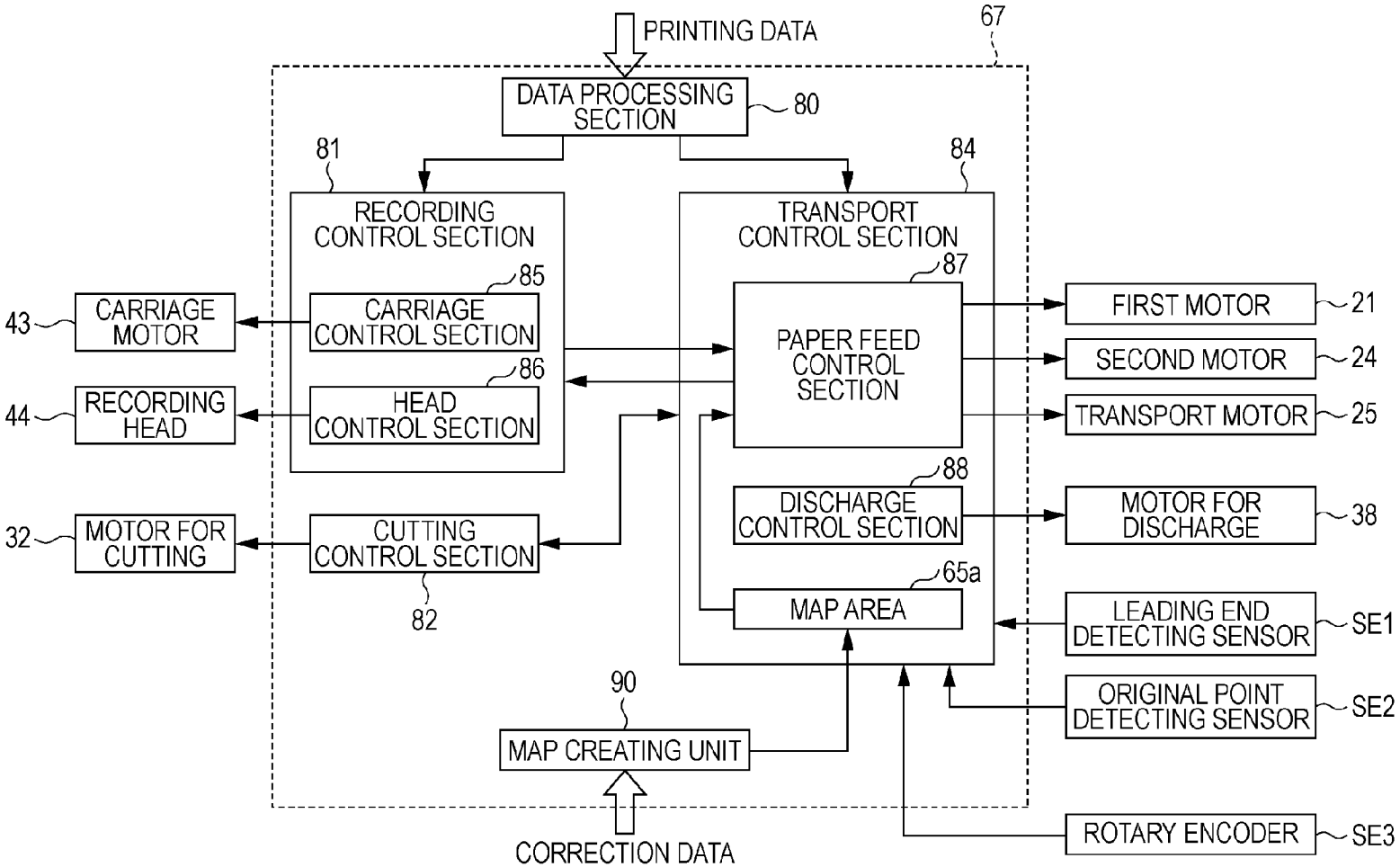
FIG. 4 is a block diagram illustrating main units of a functional configuration of a controller.

Next, the controller 67 of the embodiment will be described. In FIG. 4, for convenience of description and understanding of the specification, the various drivers 69 to 74 and 76 are not shown.

As shown in FIG. 4, the controller 67 is provided with a data processing unit 80, a recording control unit 81, a cutting control unit 82 as a cutting control unit, a transport control unit 84 as a transport control unit, and a map creating unit 90 as a creation unit, as functional parts realized by at least one of hardware and software.

The data processing unit 80 converts data other than a command of the printing data received through the interface 61, into bitmap data in which printing dots are represented by gradation values, and develops the bitmap data. The data processing unit 80 generates bitmap data of one pass on the basis of the developed data, and outputs the bitmap data of one pass to the recording control unit 81. The "one pass" represents one movement in the scanning direction X of the recording head 44 (i.e., the carriage 41) accompanied with ink ejection.

The data processing unit 80 analyzes a command included in the printing data received through the interface 61, and acquires a unit transport amount of the elongated sheet SL in a recording mode and at the time of the recording process. The data processing unit 80 outputs information about the acquired recording mode to the recording control unit 81, and outputs information about the acquired unit transport amount to the transport control unit 84. As the recording mode, for example, there are a draft printing mode stressing printing speed, and a high-detail printing mode stressing precision in printing. The "unit transport amount" is a value sufficiently smaller than the transport amount corresponding to one rotation of the transport roller 23*a*.

The recording control unit 81 has a carriage control unit 85 and a head control unit 86. The carriage control unit 85 sets movement control information such as a movement speed, a movement start position, and a stop position of the carriage 41 at the time of the recording process on the basis of the recording mode input from the data processing unit 80. The reciprocation control unit 85 controls driving of the carriage motor 43 on the basis of the set movement control information.

The head control unit 86 individually controls driving of each driving element (not shown) mounted on the recording head 44 on the basis of the input bitmap data of one pass. That is, in the embodiment, the recording control unit 81 performs the recording on the elongated sheet SL by interlocking the movement of the carriage 41 in the scanning direction X and the driving of the recording head 44. When the recording of one pass is completed, the recording control unit 81 outputs the completion result to the transport control unit 84.

When a cutting instruction of the sheet SL is input from the transport control unit 84, the cutting control unit 82 controls driving of the cutting motor 32 to cut the elongated sheet SL. When the cutting of the sheet SL is completed, the cutting control unit 82 stops the driving of the cutting motor 32, and outputs the completion result of the cutting to the transport control unit 84.

To the transport control unit 84, information about the unit transport amount is input from the data processing unit 80, and the detection signals are input from the leading end detecting sensor SE1, the original point detecting sensor SE2, and the rotary encoder SE3. The transport control unit 84 has a sheet transport control unit 87, a discharge control unit 88, and a map area 65*a*. When the leading end of the elongated sheet SL is detected on the basis of the detection signal from the leading end detecting sensor SE1, the sheet transport control unit 87 controls the driving of the first motor 21, the second motor 24, and the transport motor 25, that is, the transport amount of the elongated sheet SL on the basis of the detection result. That is, in the embodiment, the sheet transport control unit 87 manages the position of the leading end of the sheet SL on the basis of the driving amounts of the motors 21, 24, and 25 after the leading end of the elongated sheet SL is detected on the basis of the detection signal from the leading end detecting sensor SE1.

The sheet transport control unit 87 detects a rotation position θ of the transport roller 23*a* on the basis of the detection signals from the original point detecting sensor SE2 and the rotary encoder SE3. Specifically, when it is detected that the rotation position θ of the transport roller 23*a* becomes the original point position on the basis of the detection signal from the original point detecting sensor SE2, the sheet transport control unit 87 detects the rotation position θ of the transport roller 23*a* based on the original point position on the basis of the detection signal from the rotary encoder SE3. The "rotation position θ" in the embodiment represents a relative rotation position based on the original point position detected using the original point detecting sensor SE2.

When the completion result of the recording of one pass is input from the recording control unit 81 at the time of the recording process, the sheet transport control unit 87 controls the driving of the transport motor 25 to transport the sheet SL by the unit transport amount input from the data processing unit 80 on the basis of the rotation position θ of the transport roller 23*a* detected on the basis of the detection signal from the sensors SE2 and SE3, and the correction map stored in the map area 65*a*. Details of the control of the transport motor 25 at the time of the recording process will be described later. When the transport of the elongated sheet SL is completed, the sheet transport control unit 87 outputs the completion result to the recording control unit 81. That is, in the embodiment, the transport of the elongated sheet SL and the ink ejection performed by the recording head 44 are alternately performed to record an image on the elongated sheet SL.

The discharge control unit 88 controls driving of the discharge motor 38 to discharge the recording-completed part SC detached from the elongated sheet SL.

The map creating unit 90 creates the correction map in which the rotation positions θ of the transport roller 23*a* are associated with the correction amounts of the rotation positions θ on the basis of the correction data input through the interface 61. The map creating unit 90 stores the created correction map in the map area 65*a* of the transport control unit 84. The contents of the correction data and a method of creating the correction map will be described later.

Next, the correction chart will be described.

Figure 5A:
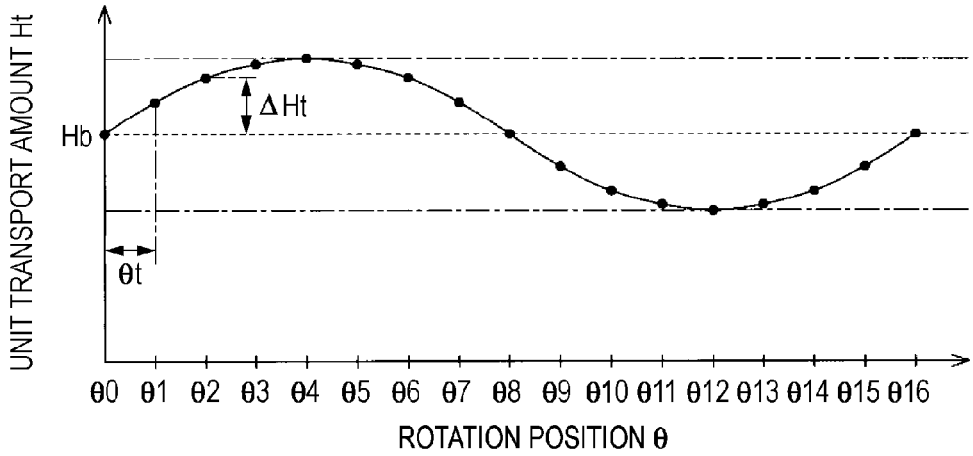
FIG. 5A is a graph illustrating an example of a relation between a rotation position and a unit transport amount of a transport roller.

When the transport roller 23*a* provided immediately to the upstream side of the recording unit 14 in the transport direction is not eccentric, and when the outer circumferential face of the transport roller 23*a* is not deformed, the transport amount of the elongated sheet SL is constant when rotating the transport roller 23*a* by a preset unit angle irrespective of the rotation position θ of the transport roller 23*a*. The transport amount of the sheet SL when rotating the transport roller 23*a* by the unit angle is referred to as "unit transport amount". That is, as shown in FIG. 5A, the unit transport amount Ht when rotating the transport roller 23*a*, which is the rotation position θ of "θ0", by the unit angle θt coincides with the unit transport amount Ht when rotating the transport roller 23*a*, which is the rotation position θ of "θ1", by the unit angle θt.

However, actually, the transport roller 23*a* of the embodiment is slightly eccentric (see FIG. 2). When the transport roller 23*a* is rotated by the unit angle θt, the unit transport amount Ht varies for each rotation position θ at the starting time of the rotation of the transport roller 23*a*. For example, the unit transport amount Ht when the rotation position θ at the starting time of the rotation is "θ0" is only a first transport amount Hb, and the unit transport amount Ht when the rotation position θ at the starting time of the rotation is "θ2" becomes a transport amount (=Hb+ΔHt) obtained by adding an error amount ΔHt to the first transport amount Hb. In the embodiment, it is assumed that the first transport amount Hb is an ideal transport amount when there is no eccentricity of the transport roller 23*a* or no deformation of the outer circumferential face.

Figure 5B:
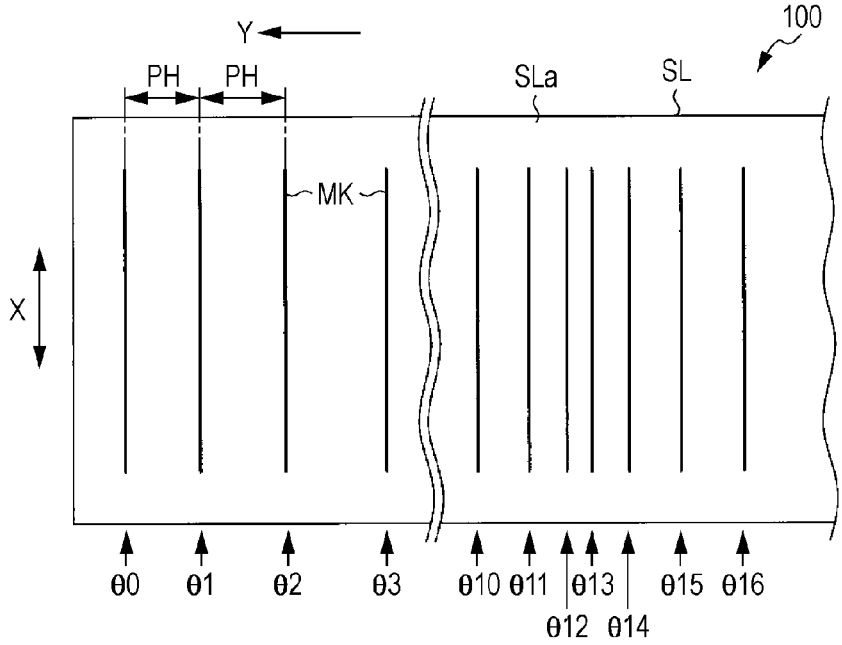
FIG. 5B is a schematic diagram illustrating an example of a correction chart.

When the correction chart is generated for the recording device 11 provided with the transport roller 23*a* with such characteristics, a correction chart 100 shown in FIG. 5B is generated. The correction chart 100 is a chart formed on the sheet SL by alternately repeating a first process of recording marks MK arranged in the scanning direction X on the surface (the recording face) SLa of the elongated sheet SL by the recording unit 14, and a second process of rotating the transport roller 23*a* by the unit angle θt. The first process and the second process are repeated until the transport roller 23*a* is rotated at least once. In an interval PH between the marks MK adjacent to each other in the transport direction Y in the correction chart 100 generated as described above, a difference occurs due to the eccentricity of the transport roller 23*a* or the deformation of the outer circumferential face of the transport roller 23*a*.

Next, a correction chart generating process routine among various control process routines performed by the controller 67 of the embodiment will be described with reference to a flowchart shown in FIG. 6. The correction chart generating process routine is a process routine to generate the correction chart 100 shown in FIG. 5B. The correction chart generating process routine is performed by inputting a generation instruction of the correction chart 100 from the printer driver PD through the interface 61.

In the correction chart generating process routine, the transport control unit 84 performs a sheet transport process of controlling the driving of the first motor 21, the second motor 24, and the transport motor 25 to transport the elongated sheet SL to the downstream side in the transport direction Y (Step S10). Subsequently, the transport control unit 84 detects (or estimates) the position in the transport direction Y of the leading end of the elongated sheet SL which is being transported, on the basis of the rotation amount or the like of the transport roller 23*a* based on the driving of the transport motor 25. The transport control unit 84 determines whether or not a protrusion amount D1 from the cutting position P1 (see FIG. 1) on the elongated sheet SL is equal to or more than a preset referential protrusion amount D1*th* (Step S11). The referential protrusion amount D1*th* is set to a value smaller than a transport amount Dmax (see FIG. 7A to FIG. 7C) of the elongated sheet SL when rotating the transport roller 23*a* once. In the embodiment, the referential protrusion amount D1*th* is set to be a value larger than half of the transport amount Dmax (see FIG. 7A to FIG. 7C) of the elongated sheet SL when rotating the transport roller 23*a* once.

When the determination result of Step S11 is negative (D1<D1*th*), the transport control unit 84 repeatedly performs the determination process of Step S11 until the determination result of Step S11 is positive. Meanwhile, when the determination result of Step S11 is positive (D1≧D1*th*), the transport control unit 84 outputs the cutting instruction to the cutting control unit 82. The cutting control unit 82 to which the cutting instruction is input performs a cutting process of detaching the unnecessary part SG further to the downstream side in the transport direction Y than the cutting position P1 with respect to the elongated sheet SL from the sheet SL (Step S12), and transfers the process to the next Step S13. The driving of the transport motor 25 may be temporarily stopped to perform the cutting process.

Before the determination process of Step S11 is positive, the original point position of the transport roller 23*a* may be detected on the basis of the detection signal from the original point detecting sensor SE2, and the leading end of the elongated sheet SL may be positioned further to the downstream side in the transport direction Y than the cutting position P1. In this case, the transport control unit 84 transfers the process to Step S14 to be described later.

In Step S13, the transport control unit 84 determines whether or not the original point position of the transport roller 23*a* is detected on the basis of the detection signal from the original point detecting sensor SE2. When the determination result is negative, the transport control unit 84 repeatedly performs the determination process of Step S13 until the original point position of the transport roller 23*a* is detected. Meanwhile, the determination result of Step S13 is positive, the transport control unit 84 determines that the leading end of the elongated sheet SL is positioned further to the downstream side in the transport direction Y than the cutting position P1 and the original point position of the transport roller 23*a* is detected. Accordingly, in the embodiment, the detection unit for detecting the original point position of the transport roller 23*a* is configured by the original point detecting sensor SE2 and the transport control unit 84.

The transport control unit 84 stops the transport motor 25 to stop the transport of the elongated sheet SL (Step S14). The transport control unit 84 outputs the cutting instruction to the cutting control unit 82. The cutting control unit 82 to which the cutting instruction is input performs a cutting process of detaching the unnecessary part SG further to the downstream side in the transport direction Y than the cutting position P1 with respect to the elongated sheet SL from the sheet SL (Step S15). Accordingly, in the embodiment, the cutting step is configured by Steps S13, S14, and S15.

Thereafter, the recording control unit 81 controls the driving of the carriage motor 43 and the recording head 44 to record the marks MK (see FIG. 5B) arranged in the scanning direction X on the elongated sheet SL (Step S16). At this time, the recording control unit 81 ejects the ink from predetermined referential nozzles of the nozzles provided in the recording head 44. In other words, the recording control unit 81 does not eject the ink from nozzles other than the referential nozzles.

The transport control unit 84 controls the driving of the transport motor 25 to rotate the transport roller 23*a* in a predetermined direction by the unit angle θt (Step S17). The "predetermined direction" is a rotation direction to transport the elongated sheet SL to the downstream side in the transport direction Y. Subsequently, after completing the cutting process of Step S15, the transport control unit 84 determines whether or not the transport roller 23*a* is rotated once based on the detection signals from the original point detecting sensor SE2 and the rotary encoder SE3 (Step S18). When the determination result is negative, that is, the transport roller 23*a* is not rotated once yet, the recording control unit 81 transfers the process to Step S16 described above.

Meanwhile, when the determination result of Step S18 is positive, the recording control unit 81 records the marks MK arranged in the scanning direction X on the elongated sheet SL in the same manner as the process of Step S16 (Step S19), and transfers the process to the next Step S20. Accordingly, in the embodiment, the generation unit is configured by the recording control unit 81 and the transport control unit 84. The generation step of generating the correction chart 100 is configured by Steps S16, S17, S18, and S19.

In Step S20, the transport control unit 84 performs a first discharge process of controlling the driving of the transport motor 25 and the discharge motor 38 to discharge the correction chart 100 formed on the elongated sheet SL. The transport control unit 84 stops the transport motor 25 and the discharge motor 38 at the timing when the rear end (the upstream end in the transport direction Y) of the correction chart 100 is moved further to the downstream side in the transport direction Y than the cutting position P1, and outputs the cutting instruction to the cutting control unit 82. The cutting control unit 82 to which the cutting instruction is input performs a cutting process of controlling the cutting motor 32 to detach the correction chart 100 from the elongated sheet SL (Step S21). Subsequently, the transport control unit 84 performs a second discharge process of controlling the driving of the discharge motor 38 to discharge the correction chart 100 detached from the elongated sheet SL (Step S22). Thereafter, the transport control unit 84 stops the discharge motor 38 at the timing when the correction chart 100 is discharged to the discharge tray 18, and completes the correction chart generating process routine.

Figure 7A:
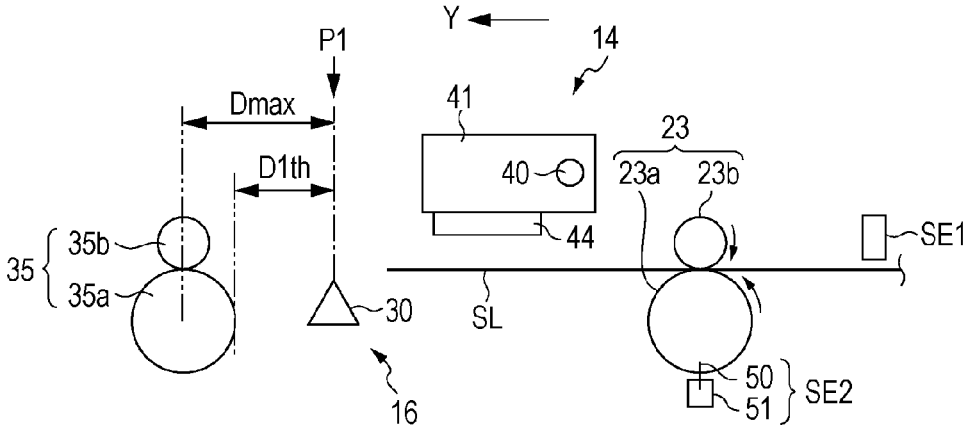
FIG. 7A to FIG. 7C are diagrams illustrating operations of transporting an elongated sheet.
Figure 7B:
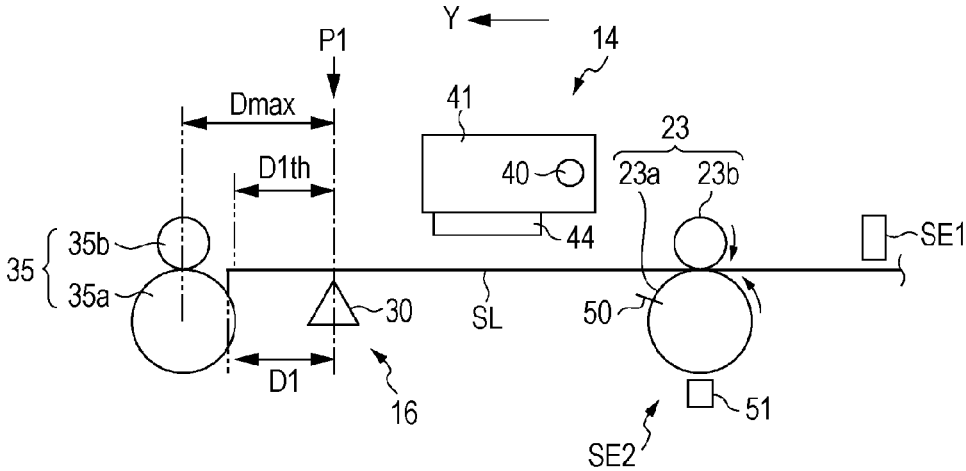
Figure 7C:
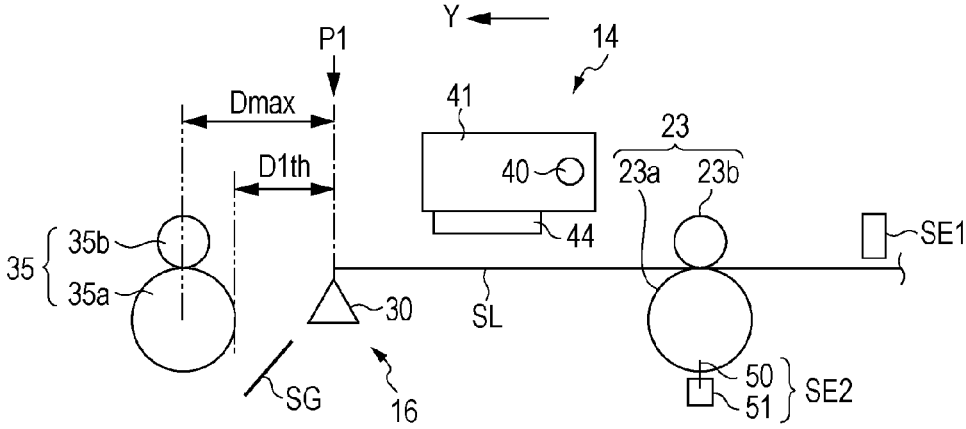

In the embodiment, as shown in FIG. 7A, even when the original point position of the transport roller 23*a* is detected by the original point detecting sensor SE2, the transport of the elongated sheet SL is continued by the transport unit 15 when the leading end of the elongated sheet SL is positioned further to the upstream side in the transport direction Y than the cutting position P1. Thereafter, as shown in FIG. 7B, when the leading end of the elongated sheet SL is moved further to the downstream side in the transport direction Y than the cutting position P1 and the protrusion amount D1 from the cutting position P1 of the sheet SL is equal to or more than the referential protrusion amount D1*th*, the part further to the downstream side in the transport direction Y than the cutting position P1 with respect to the elongated sheet SL is detached as the unnecessary part SG from the sheet SL. The unnecessary part SG is collected in the collection box 55 (see FIG. 1).

Thereafter, when the original point position of the transport roller 23*a* is detected by the original point detecting sensor SE2, the transport of the sheet SL performed by the transport unit 15 is stopped since the leading end of the elongated sheet SL is positioned further to the downstream side in the transport direction Y than the cutting position P1. The part further to the downstream side in the transport direction Y than the cutting position P1 with respect to the elongated sheet SL is detached as the unnecessary part SG from the sheet SL. As described above, the generation of the correction chart 100 is started from the state where the leading end of the elongated sheet SL is positioned at the cutting position P1.

For this reason, in the method of generating the correction chart 100 in the embodiment, the position in the transport direction Y of the leading end of the elongated sheet SL at the starting time of the generating the correction chart 100 can be made constant. That is, the position in the transport direction Y of the leading end of the sheet SL at the time of generating the correction chart 100 at this time is the same as the position in the transport direction Y of the leading end of the sheet SL at the time of generating the correction chart 100 at the previous time. For this reason, the magnitude of load applied to the transport roller 23*a* and the transport motor 25 through the elongated sheet SL at the time of generating correction chart 100 at this time may be substantially the same as that at the time of generating the previous correction chart 100. As a result, the difference of the unit transport amount Ht of the elongated sheet SL caused by the change of the load applied to the transport motor 25 is suppressed.

Figure 8A:
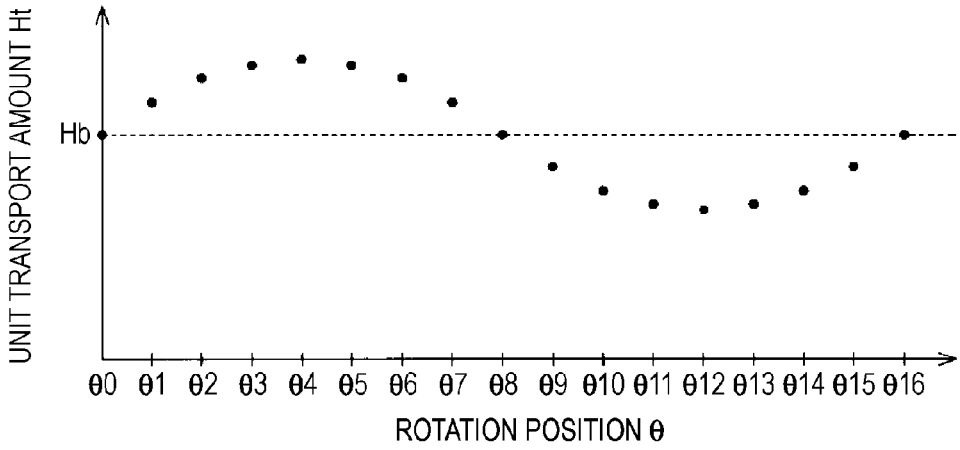
FIG. 8A is a graph illustrating an example of a relation between a rotation position and a unit transport amount of the transport roller.

When the correction chart 100 is discharged from the recording device 11, a user makes a scanner device (not shown) connected to the host device HC communicate information read the correction chart 100. Subsequently, in the host device HC, as shown in FIG. 8A, correction data including the rotation positions θ (θ0 to θ16) of the transport roller 23*a* and the unit transport amounts Ht corresponding to the rotation positions θ, respectively, is generated. The unit transport amount Ht of each rotation position θ is acquired on the basis of the interval PH between the marks MK adjacent to each other in the transport direction Y with respect to the correction chart 100 (see FIG. 5B). Thereafter, the generated correction data is transmitted from the host device HC to the recording device 11.

Next, a correction map creating process routine performed by the controller 67 of the embodiment will be described with reference to a flowchart shown in FIG. 9 and the drawings shown in FIGS. 8A and 8B. The correction map creating process routine is a process routine to create the correction map shown in FIG. 8B on the basis of the correction data shown in FIG. 8A. The correction map creating process routine is performed at the timing when the reception of the correction data is started.

In the correction map creating process routine, the map creating unit 90 determines whether or not the reception of the correction data is completed (Step S30). When the determination result is negative, the map creating unit 90 repeatedly performs the determination process of Step S30 until the reception of the correction data is completed. Meanwhile, when the determination result of Step S30 is positive, the map creating unit 90 performs a map creating process since the reception of the correction data is completed (Step S31).

Figure 8B:
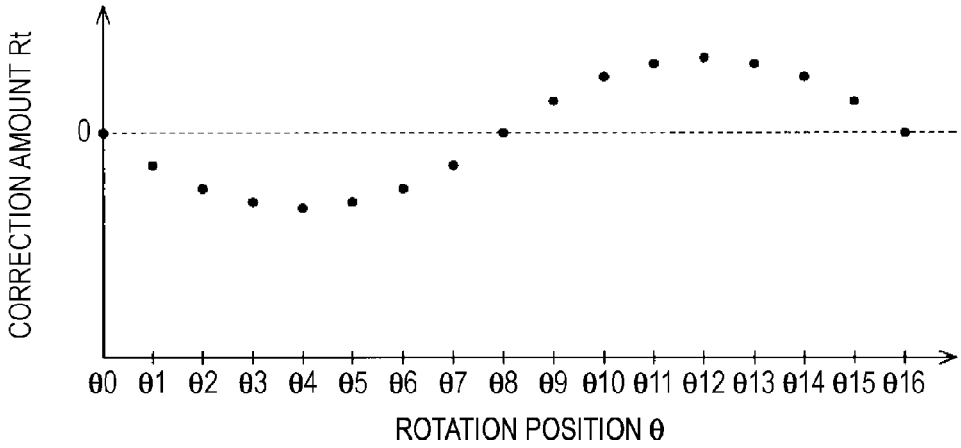
FIG. 8B is a map illustrating an example of a relation between a rotation position and a correction amount of the transport roller.

Specifically, as shown in FIG. 8A and FIG. 8B, the map creating unit 90 calculates the rotation positions θ (θ0 to θ16) of the transport roller 23*a* and correction amounts Rt corresponding to the rotation positions θ, respectively, on the basis of the received correction data. For example, since the unit transport amount Ht when the rotation position θ is "θ0" is the first transport amount Hb, the correction amount Rt when the rotation position θ is "θ0" is set to be "0 (zero)". In addition, since the unit transport amount Ht when the rotation position θ is "θ1" is larger than the first transport amount Hb, the correction amount Rt when the rotation position θ is "θ1" is set to be a value smaller than "0 (zero)". Furthermore, since the unit transport amount Ht when the rotation position θ is "θ9" is smaller than the first transport amount Hb, the correction amount Rt when the rotation position θ is "θ9" is set to be a value larger than "0 (zero)".

Figure 9:
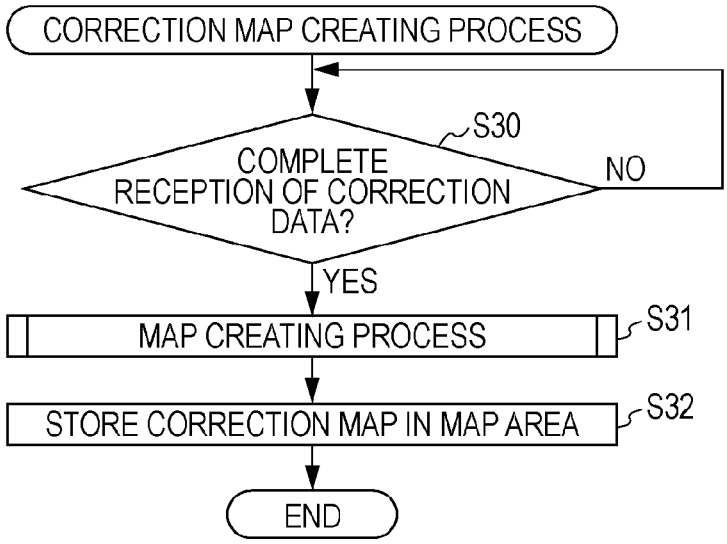
FIG. 9 is a flowchart illustrating a correction map creating process routine.

Returning to the flowchart shown in FIG. 9, when the map creating process is completed, the map creating unit 90 stores the correction map created in Step S31 in the map area 65*a* (see FIG. 4) (Step S32). Accordingly, in the embodiment, Step S32 corresponds to the storage step. Thereafter, the map creating unit 90 completes the correction map creating process routine.

Figure 10:
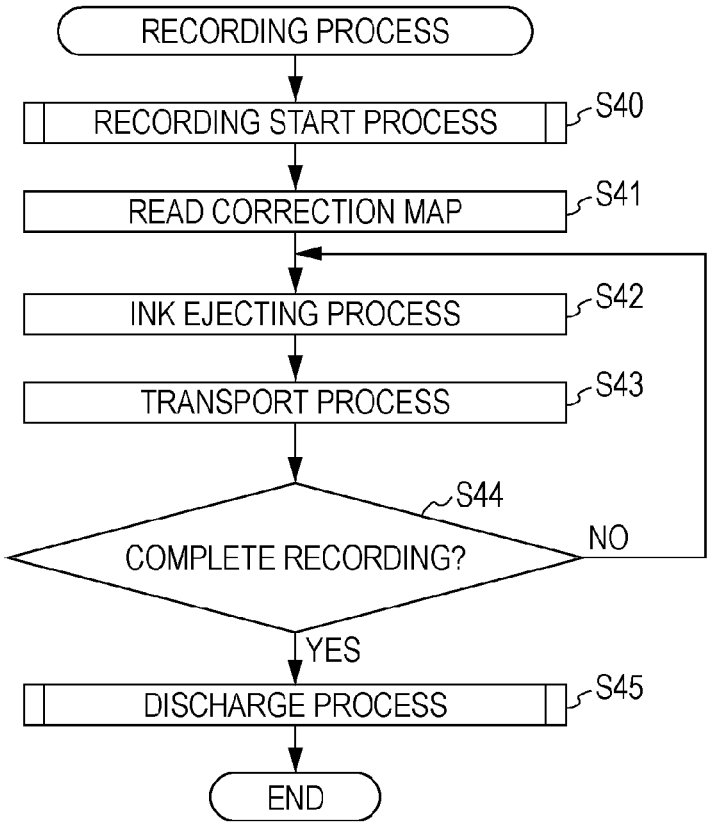
FIG. 10 is a flowchart illustrating a recording process routine.

Next, a recording process routine performed by the controller 67 after creating the correction map will be described with reference to a flowchart shown in FIG. 10. The recording process routine is performed at the timing of starting the reception of the printing data from the printer driver PD side.

In the recording process routine, the data processing unit 80 performs a recording start process of analyzing a command included in the received printing data, and outputting the analysis result or the like to the recording control unit 81 and the transport control unit 84 (Step S40). Subsequently, the transport control unit 84 reads the correction map from the map area 65*a* (Step S41).

The recording control unit 81 performs an ink ejecting process of individually controlling the carriage motor 43 and the recording head 44 on the basis of the bitmap data of one pass input from the data processing unit (Step S42). Subsequently, the transport control unit 84 performs a transport process of acquiring the correction amount Rt corresponding to the rotation position θ of the transport roller 23*a* at this time point from the correction map, and adjusting the rotation amount of the transport roller 23*a*, that is, the driving amount of the transport motor 25 on the basis of the acquired correction amount Rt (Step S43). Accordingly, in the embodiment, Step S43 corresponds to the transport step of transporting the elongated sheet SL while correcting the driving amount of the transport motor 25 for each rotation position θ of the transport roller 23*a* on the basis of the correction map at the time of the recording process.

The data processing unit 80 determines whether or not the recording is completed on the basis of the command included in the received printing data (Step S44). When the determination result is negative, the data processing unit 80 continues outputting the bitmap data of one pass to the recording control unit 81 since the recording is not yet completed. That is, in the embodiment, an image is recorded on the elongated sheet SL by the repetition of the ink ejecting process and the transport process.

Meanwhile, when the determination result of Step S44 is positive, the transport control unit 84 performs a discharge process including the processes equivalent to Steps S20, S21, and S22 described above since the recording is completed (Step S45), and then completes the recording process routine.

That is, when the recording process is performed in the state where the correction map is stored in the map area 65*a*, the rotation amount of the transport roller 23*a*, that is, the driving amount of the transport motor 25 is corrected on the basis of the correction map in the transporting of the elongated sheet SL performed during the ejection of the ink by the recording unit 14. As a result, the difference of the unit transport amount Ht of the sheet SL at the time of the transport process is suppressed.

According to the embodiment, it is possible to obtain the following effects.

(1) In the step in which the original point position of the transport roller 23*a* is detected using the original point detecting sensor SE2, when the leading end of the elongated sheet SL is positioned further to the downstream side in the transport direction Y than the cutting position P1, the sheet SL is cut by the cutter 30. Thereafter, the correction chart 100 is generated on the sheet SL by driving the transport unit 15 and the recording unit 14. That is, when the generation of the correction chart 100 is started, the leading end of the elongated sheet SL is positioned at the cutting position P1. For this reason, the load applied to the transport roller 23*a* and the transport motor 25 through the elongated sheet SL at the time point of starting the generation of the correction chart 100 is substantially constant every time. In addition, since it is possible to detect the original point position of the transport roller 23*a* even when the absolute position type encoder is not used, it is possible to achieve cost decreases as compared with a case of providing the recording device 11 with the absolute position type encoder. Accordingly, it is possible to stabilize and generate the correction chart 100 while suppressing cost increases.

(2) The timing when the downstream end of the elongated sheet SL in the transport direction Y comes in contact with the discharge roller base 35 or the guide unit 39 is not changed whenever the correction chart 100 is generated. For this reason, the load applied to the transport roller 23*a* and the transport motor 25 through the elongated sheet SL is not changed whenever the correction chart 100 is generated. Accordingly, when the shape of the outer circumferential face of the transport roller 23*a* is not deformed from the time of generating the previous correction chart 100, it is possible to generate the correction chart 100 substantially equivalent to the previous correction chart 100.

(3) When the cutting of the elongated sheet SL by the cutter 30 is not performed until the original point position of the transport roller 23*a* is detected and the original point position of the transport roller 23*a* is detected, the unnecessary part SG with a size corresponding to the transport amount of the sheet SL when rotating the transport roller 23*a* once may be detached from the sheet SL. For this reason, it is necessary to configure the collection box 55 to collect such a relatively large unnecessary part SG. From this viewpoint, in the embodiment, the size of the unnecessary part SG detached from the elongated sheet SL by the cutter 30 is smaller than the size corresponding to the transport amount of the sheet SL when rotating the transport roller 23*a* once. For this reason, it is possible to reduce the size of the collection box 55 collecting the unnecessary part SG as compared with the case of not performing the cutting of the sheet SL by the cutter 30 until the original point position of the transport roller 23*a* is detected, and further it is possible to contribute to miniaturization of the whole recording device 11.

(4) The correction map in which the rotation positions θ of the transport roller 23*a* are associated with the correction amounts Rt of the rotation positions θ is created and stored in the map area 65*a* by inputting the correction data based on the generated correction chart 100. At the time of the transport process of the elongated sheet SL in the recording process, the driving amount of the transport motor 25 is adjusted for each rotation position θ of the transport roller 23*a* on the basis of the correction map stored in the map area 65*a*. Accordingly, it is possible to suppress the difference of the unit transport amount Ht of the elongated sheet SL. That is, it is possible to improve quality of the image recorded by the recording device 11.

Second Embodiment

Next, a second embodiment of the invention will be described with reference to FIG. 11 and FIG. 12. The second embodiment is different from the first embodiment in that the recording device 11 is provided with an image reading device. Accordingly, in the following description, parts different from the first embodiment are mainly described, the same reference numerals and signs are given to configuration of members equal to or corresponding to those of the first embodiment, and the repeated description is omitted.

Figure 11:
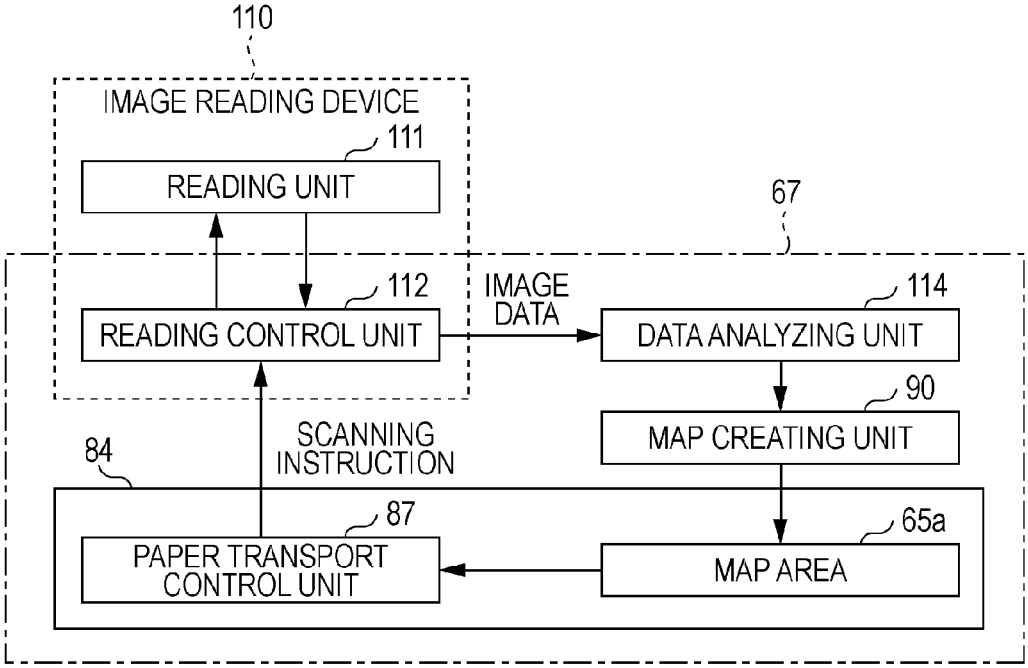
FIG. 11 is a block diagram illustrating main parts of a recording device of a second embodiment.
Figure 12:
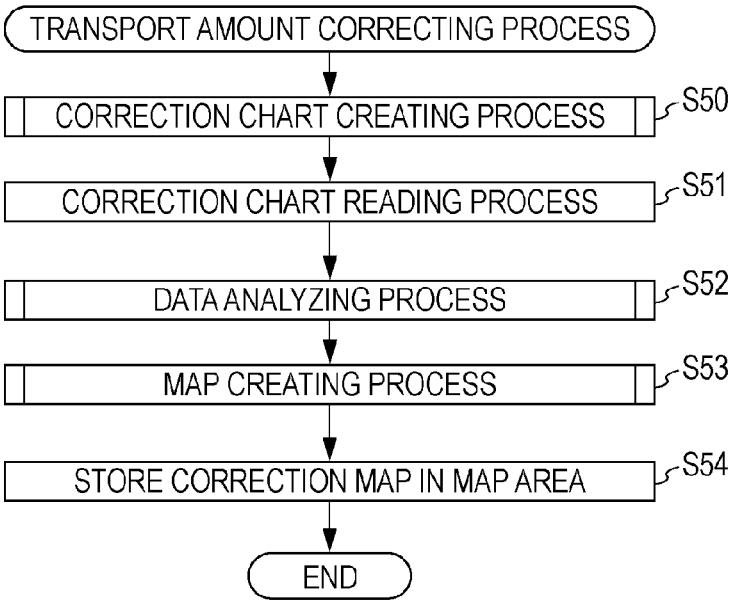
FIG. 12 is a flowchart illustrating a transport amount correcting process routine.

As shown in FIG. 11, the recording device 11 according to the embodiment is provided with an image reading device 110 reading an image recorded on a surface (recording face) SLa of the elongated sheet SL. The image reading device 110 is provided with a reading unit 111 as an example of a reading unit provided further to the downstream side than the cutting position P1 in the transport direction Y, and a reading control unit 112 controlling the reading unit 111.

The reading unit 111 has a lamp (not shown) irradiating the surface of the sheet which is being discharged to the downstream side in the transport direction Y by the discharge unit 17 with light, and a CCD (charge-coupled device) (now shown) to acquire the image of the sheet as image data. The reading unit 111 detects reflection light from the sheet by the CCD while irradiating the sheet transmitted to the downstream side in the transport direction Y with the light, and outputs a reading signal based on the detection result of the CCD to the reading control unit 112.

The reading control unit 112 is a functional part realized by at least one of hardware and software constituting the controller 67. When a scanning instruction is input from the transport control unit 84, the reading control unit 112 controls the reading unit 111 to read the image recorded on the sheet. The reading control unit 112 analyzes the reading signal from the reading unit 111 to acquire the image of the sheet as the image data, and outputs the image data to a data analyzing unit 114. The data analyzing unit 114 analyzes the input image data, and outputs the analysis result to the map creating unit 90.

Next, a transport amount correcting process routine performed by the controller 67 of the embodiment will be described with reference to a flowchart shown in FIG. 12. The transport amount correcting process routine is a process routine for analyzing the correction chart 100 generated by the recording device 11 to automatically create the correction map.

Figure 6:
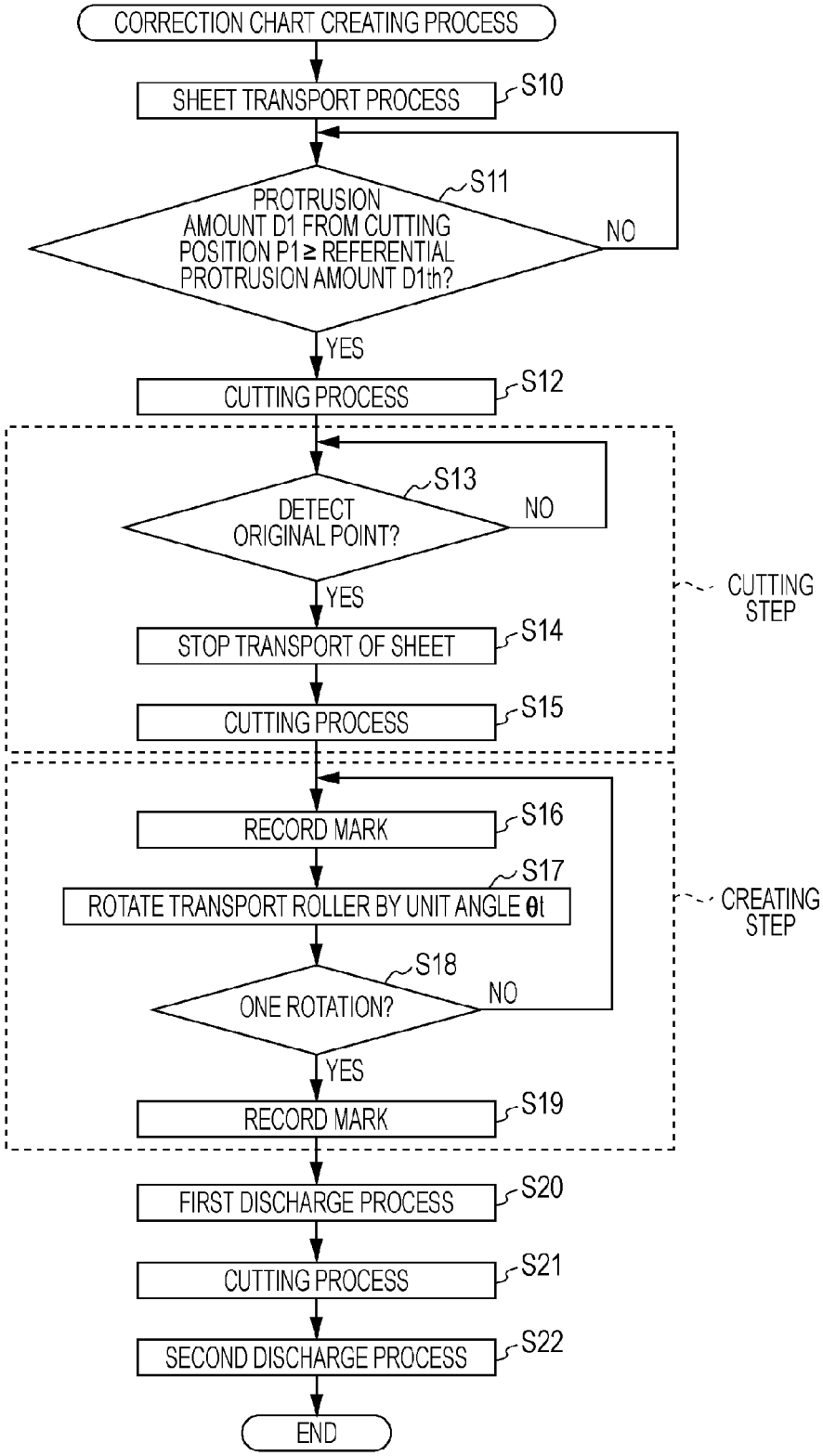
FIG. 6 is a flowchart illustrating a correction chart generating process routine.

In the transport amount correcting process, the recording control unit 81 and the transport control unit 84 perform the correction chart generating process described in FIG. 6 (Step S50). The transport control unit 84 outputs the scanning instruction to the reading control unit 112 at the timing when the cutting process of Step S21 is completed. Subsequently, the reading control unit 112 performs a correction chart reading process of reading the correction chart 100 transported to the downstream side in the transport direction Y (Step S51). When the correction chart reading process is completed, the reading control unit 112 outputs the read image data to the data analyzing unit 114.

The data analyzing unit 114 performs a data analyzing process of analyzing the input image data (Step S52). That is, the data analyzing unit 114 acquires the interval PH between the marks (see FIG. 5B) MK adjacent to each other in the transport direction Y. The data analyzing unit 114 generates the correction data (see FIG. 8A) including the rotation positions θ of the transport roller 23*a* and the unit transport amounts Ht corresponding to the rotation positions θ, respectively, on the basis of the acquired interval PH, and outputs the correction data to the map creating unit 90. Accordingly, in the embodiment, the data analyzing unit 114 serves as the acquisition unit.

Subsequently, the map creating unit 90 sequentially performs the processes of Steps S53 and S54 equivalent to Steps S31 and S32 described above, and then completes the transport amount correction process routine.

Accordingly, in the embodiment, it is possible to further obtain the following effect in addition to the effects (1) to (4) in the first embodiment.

(5) The recording device 11 of the embodiment is provided with the image reading device 110. For this reason, it is possible to read the generated correction chart 100 in the course of the discharging thereof. As a result, the interval PH between the marks MK of the generated correction chart 100 is automatically read, and the correction map is automatically created. At the time of the transport control of the elongated sheet SL in the recording process, the driving amount of the transport motor 25 is adjusted for each rotation position θ of the transport roller 23*a* on the basis of the created correction map. Accordingly, it is possible to automatically suppress the difference of the unit transport amount Ht of the elongated sheet SL causing the user trouble, and further it is possible to improve quality of the image recorded by the recording device 11.

The embodiments may be modified as follows.

In the first embodiment, the correction data input through the interface 61 may be correction data including the rotation positions θ of the transport roller 23*a* and the correction amount Rt corresponding to the rotation positions θ, respectively. In this case, the map creating unit 90 may store the input correction data as the correction map in the map area 65*a*. That is, it is possible to reduce the control load on the recording device 11 side by the amount not necessary for creating the correction map on the basis of the correction data in the recording device 11.

In the embodiments, the referential protrusion amount D1*th* may be an arbitrary value which is a value smaller than the transport amount Dmax (see FIG. 7A to FIG. 7C) of the elongated sheet SL. For example, the referential protrusion amount D1*th* may be a value smaller than a half of the transport amount Dmax. In this case, at the time of performing the correction chart generating process routine, the cutting process may be performed many times until the determination result of Step S13 is positive.

In the embodiments, the correction chart generating process routine may be a process routine which does not include the processes of Steps S11 and S12. In this case, the sheet SL is not cut until the original point position of the transport roller 23*a* is detected in a state where the leading end of the elongated sheet SL is positioned further to the downstream side in the transport direction Y than the cutting position P1. In this case, it is preferable to increase the size of the collection box 55, to reliably collect the unnecessary part SG detached from the sheet SL by the cutting process of Step S15 as compared with the embodiments described above.

In the embodiments, the discharge unit 17 may have a configuration of discharging the medium to the downstream side in the transport direction Y using an endless transport belt. In this case, the recording-completed part SC or the correction chart 100 is discharged to the downstream side in the transport direction Y in a state where it is placed on the transport belt.

In the embodiments, the cutting position P1 may be set further to the upstream side in the transport direction Y than the recording head 44.

In the embodiments, the correction chart 100 may be generated after rewinding the sheet SL after the cutting process is performed at the timing when the original point position of the transport roller 23*a* is detected in the state where the leading end of the elongated sheet SL is positioned further to the downstream side in the transport direction Y than the cutting position P1. In this case, since the marks MK are formed from the position close to the leading end of the elongated sheet SL, it is possible to reduce the amount of use of the sheet SL at the time of generating the correction chart 100.

In the embodiments, the marks MK may have an arbitrary shape such as a dot, which is a shape readable (i.e., scannable) by the image reading device or the like.

In the embodiments, when the transport motor 25 is a motor (e.g., a stepping motor) which can acquire the driving amount on the controller 67 side without employing a sensor, the rotary encoder SE3 may not be provided.

In the embodiments, the sensor for detecting the leading end of the elongated sheet SL may be provided on the downstream side in the transport direction Y of the cutting position P1. In this case, when the leading end of the sheet SL is detected by the sensor at the time point when the original point position of the transport roller 23*a* is detected, the cutting of the sheet SL may be performed, and then the correction chart 100 may be generated.

In the embodiments, the carriage 41 is generally provided with a sensor for detecting both ends of the width direction of the sheet SL. In this case, the leading end of the elongated sheet SL may be detected employing the sensor, and the position of the leading end of the sheet SL may be estimated on the basis of the detection result and the rotation amount of the transport roller 23*a*.

In the embodiments, the recording unit 14 may be specified as a so-called line head type recording unit in which the recording head 44 does not move in the course of the recording process.

In the embodiments, the medium may be an arbitrary medium such as a cloth, a resin film, a resin sheet, and a metal sheet, which can be cut by a cutting portion such as the cutter 30.

In the embodiments, the recording device 11 may be specified as a fluid ejecting device that jets or ejects out a fluid other than the ink. In addition, the recording device 11 may be specified as various liquid ejecting devices provided with a liquid ejecting head or the like which ejects a small amount of liquid droplets. In this case, the liquid droplets means a liquid state where they are ejected from the liquid ejecting device, and includes a granular state, a moisture state, and a filaceous state. The liquid described herein may be a material which can be ejected by the liquid ejecting device. For example, the liquid is preferably a liquefied material, and includes a liquid body with high or low viscosity, a sol, a gel water, an inorganic solvent, an organic solvent, a solution, a liquid resin, a fluid body such as a liquid metal (molten metal), and a material in which functional material particles formed of solid materials such as pigments and metal particles are dissolved, dispersed, or mixed, as well as the liquid as one state of materials. As a representative example of liquid, there are the ink described in the embodiments, liquid crystal, and the like. The ink includes various liquid compositions such as a general aqueous ink and oily ink, a gel ink, and a hot-melt ink. As a specific example of the liquid ejecting device, there is a liquid ejecting device that ejects a liquid including a material such as an electrode material and a color material used in production or the like of, for example, a liquid crystal display, an EL (electroluminescent) display, a surface-emitting display, and a color filter, in a dispersed or dissolved state. In addition, the liquid ejecting device may be a liquid ejecting device ejecting a bio-organic material used in production of a bio-chip, a liquid ejecting device ejecting a liquid which is used as a precious pipette and is a sample, a printing device, a micro-dispenser, and the like. The invention may be applied to at least one kind of the liquid ejecting devices. The fluid may be powder and granular materials such as toner.

The fluid described in the specification does not include a material formed of only gas. The recording described in the specification is not limited to printing on the sheet such as paper. For example, the recording is a concept including that an ink (or paste) prepared by a material for elements or wirings is attached onto a substrate (recording medium) to form a circuit by recording when an electric circuit is produced.

In the embodiments, the recording device 11 may be a recording device performing recording on the medium in the other manner such as a dot impact manner and a laser manner.

A technical concept which can be recognized from the embodiments and the other embodiments is additionally described hereinafter.

When the original point position of the transport roller is detected by the detection unit and the downstream end in the transport direction of the medium in the transport direction transported by the transport unit is positioned further to the downstream side in the transport direction than the cutting position, the recording device controls the cutting unit to detach the part positioned further to the downstream side in the transport direction than the cutting position, from the medium then rotates the transport roller to transport the medium to the downstream side in the transport direction, and controls the transport unit and the recording unit to form the marks on the medium every timing when the transport roller is rotated by a constant amount, thereby generating the correction chart.

What is claimed is:

1. A recording device comprising:

a transport unit that has a transport roller rotating to transport a medium along a transport direction;

a recording unit that attaches a fluid to the medium transported by the transport unit;

a generation unit that controls the transport unit and the recording unit to generate a correction chart in which marks are formed at a plurality of positions in the transport direction by the attachment of the fluid to the medium;

a cutting unit that cuts the medium at a cutting position set on a downstream side in the transport direction of the transport roller; and a detection unit that has a detection target unit provided to be rotatable integrally with the transport roller and a detector detecting the detection target unit moving to an original point position in a circumferential direction, wherein when the original point position of the transport roller is detected by the detection unit and a downstream end in the transport direction of the medium is positioned further to the downstream side in the transport direction than the cutting position, the generation unit controls the cutting unit to cut the medium and then controls the transport unit and the recording unit to generate the correction chart.

2. The recording device according to claim 1, further comprising a discharge unit that is provided further to the downstream side than the cutting position in the transport direction and transports the medium to the downstream side in the transport direction.

3. The recording device according to claim 1, further comprising:

a collection unit that is provided on a lower side in a gravity direction of the cutting position and collects a cut part detached from the medium by the cutting unit; and a cutting control unit that controls the cutting unit when the correction chart is generated by the generation unit, wherein when the original point position of the transport roller is not detected by the detection unit and a protrusion amount of the medium to the more downstream side in the transport direction than the cutting position is equal to or more than a referential protrusion amount set to an amount less than a transport amount of the medium corresponding to one rotation of the transport roller, the cutting control unit controls the cutting unit to detach a part positioned further to the downstream side in the transport direction than the cutting position.

4. The recording device according to claim 1, wherein the transport unit has a transport motor generating driving power to rotate the transport roller, and wherein the recording device further comprises:

an input unit to which correction data based on the generated correction chart is input;

a storage unit that stores a correction map which is a map based on the correction chart and in which a plurality of rotation positions of the transport roller is associated with the correction amounts of the rotation positions, respectively; and a transport control unit that adjusts a driving amount of the transport motor for each rotation position of the transport roller on the basis of the correction map stored in the storage unit at the time of a recording process on the medium using the fluid.

5. The recording device according to claim 1, wherein the transport unit has a transport motor generating driving power to rotate the transport roller, and wherein the recording device further comprises:

a reading unit that is provided further to the downstream side in the transport direction than the cutting position and reads an image recorded on a recording face of the medium opposed to the recording unit in the medium;

an acquisition unit that acquires an interval of the marks formed on the correction chart for each rotation position of a transport roller when the correction chart formed on the medium is read by the reading unit;

a creation unit that creates a correction map in which a plurality of rotation positions of the transport roller is associated with correction amounts for the rotation positions on the basis of the acquisition result acquired by the acquisition unit;

a storage unit in which the correction map created by the creation unit is stored; and a transport control unit that adjusts a driving amount of the transport motor for each rotation position of the transport roller on the basis of the correction map stored in the storage unit at the time of the recording process on the medium using the fluid.

* * * * *